US010429111B2

(12) United States Patent
Austin, Jr.

(10) Patent No.: US 10,429,111 B2
(45) Date of Patent: Oct. 1, 2019

(54) INTEGRATED SUCTION HEADER ASSEMBLY

(71) Applicant: Heatcraft Refrigeration Products LLC, Richardson, TX (US)

(72) Inventor: Robert H. Austin, Jr., Columbus, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 788 days.

(21) Appl. No.: 14/630,695

(22) Filed: Feb. 25, 2015

(65) Prior Publication Data

US 2016/0245567 A1 Aug. 25, 2016

(51) Int. Cl.

| | |
|---|---|
| ***F25B 49/02*** | (2006.01) |
| ***F25B 40/00*** | (2006.01) |
| ***F25B 5/02*** | (2006.01) |
| ***F25B 41/00*** | (2006.01) |

(52) U.S. Cl.

CPC ..... *F25B 49/02* (2013.01); *F25B 5/02* (2013.01); *F25B 41/003* (2013.01); *F25B 40/00* (2013.01); *F25B 2400/04* (2013.01); *F25B 2400/051* (2013.01); *F25B 2400/075* (2013.01); *F25B 2400/13* (2013.01)

(58) Field of Classification Search

CPC ..... F25B 2400/13; F25B 2400/051; F25B 2400/054

See application file for complete search history.

(56) References Cited

U.S. PATENT DOCUMENTS

| | | | | |
|---|---|---|---|---|
| 2,121,253 | A * | 6/1938 | McGuffey | F25B 40/00 62/471 |
| 2,402,802 | A * | 6/1946 | Carter | F25B 39/028 62/504 |
| 4,318,277 | A | 3/1982 | Cann et al. | |
| 2008/0296005 | A1* | 12/2008 | Taras | F25B 13/00 165/173 |
| 2010/0199707 | A1 | 8/2010 | Pearson | |
| 2013/0091874 | A1* | 4/2013 | Sillato | F25B 49/022 62/56 |
| 2013/0213081 | A1 | 8/2013 | Zhang et al. | |
| 2014/0352343 | A1 | 12/2014 | Hinde et al. | |

FOREIGN PATENT DOCUMENTS

| | | |
|---|---|---|
| GB | 2405688 A | 9/2005 |
| GB | 2489825 A | 10/2012 |

OTHER PUBLICATIONS

Sporlan, "Evaporator Pressure Regulating Valves for Evaporator Temperature Control", Jun. 2010/RACE Catalogue 90-20 UK.*

* cited by examiner

*Primary Examiner* — Orlando E Aviles
(74) *Attorney, Agent, or Firm* — Winstead PC

(57) ABSTRACT

The present application provides a refrigeration system. The refrigeration system may include an evaporator assembly, a suction header assembly with a suction header heat exchanger therein, and a liquid header in communication with the suction header heat exchanger.

15 Claims, 3 Drawing Sheets

INTEGRATED SUCTION HEADER ASSEMBLY

TECHNICAL FIELD

The present application and the resultant patent relate generally to refrigeration systems and more particularly relate to refrigeration systems including an integrated suction header assembly with an internal heat exchanger for liquid sub-cooling.

BACKGROUND OF THE INVENTION

Modern air conditioning and refrigeration systems provide cooling, ventilation, and humidity control for all or part of a climate controlled area such as a refrigerator, a cooler, a building, and the like. Generally described, a conventional refrigeration cycle includes four basic stages to provide cooling. First, a vapor refrigerant is compressed within one or more compressors at high pressure and high temperature. Second, the compressed vapor is cooled within a condenser by heat exchange with ambient air drawn or blown across a condenser coil by a fan and the like. Third, the liquid refrigerant is passed through an expansion device that reduces both the pressure and the temperature of the liquid refrigerant. The liquid refrigerant is then pumped within the climate controlled area to one or more evaporators. The liquid refrigerant absorbs heat from the surroundings in an evaporator coil as the liquid refrigerant evaporates to a vapor. Finally, the vapor refrigerant returns to the compressor and the cycle repeats. Various alternatives on this basic refrigeration cycle are known and also may be used herein.

Current design trends in refrigeration systems focus on increased efficiency, reduced energy consumption, and other types of environmentally friendly improvements. Similarly, other design goals may focus on reducing the complexity and costs typically found in modern refrigeration systems. There is thus a desire for improved refrigeration systems with respect to efficiency, energy usage, complexity, and costs.

SUMMARY OF THE INVENTION

The present application and the resultant patent thus provide a refrigeration system. The refrigeration system may include an evaporator assembly, a suction header assembly with a suction header heat exchanger therein, and a liquid header in communication with the suction header heat exchanger. The suction header heat exchanger provides sub-cooling with an opposed refrigerant flow within the suction header.

The present application and the resultant patent further provide a method of operating a refrigeration system. The method may include the steps of receiving an evaporator flow from an evaporator assembly, flowing the evaporator flow though a suction header assembly, receiving a receiver flow from a condenser assembly, flowing the receiver flow through a suction header heat exchanger in the suction header assembly, and exchanging heat between the evaporator flow and the receiver flow.

The present application and the resultant patent further provide a refrigeration system. The refrigeration system may include an evaporator assembly, a suction header assembly for receiving an evaporator flow from the evaporator assembly, the suction header assembly including a suction header heat exchanger therein, and a receiver. The suction header heat exchanger receives a receiver flow from the receiver such that the evaporator flow and the receiver flow exchange heat in the suction header assembly.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
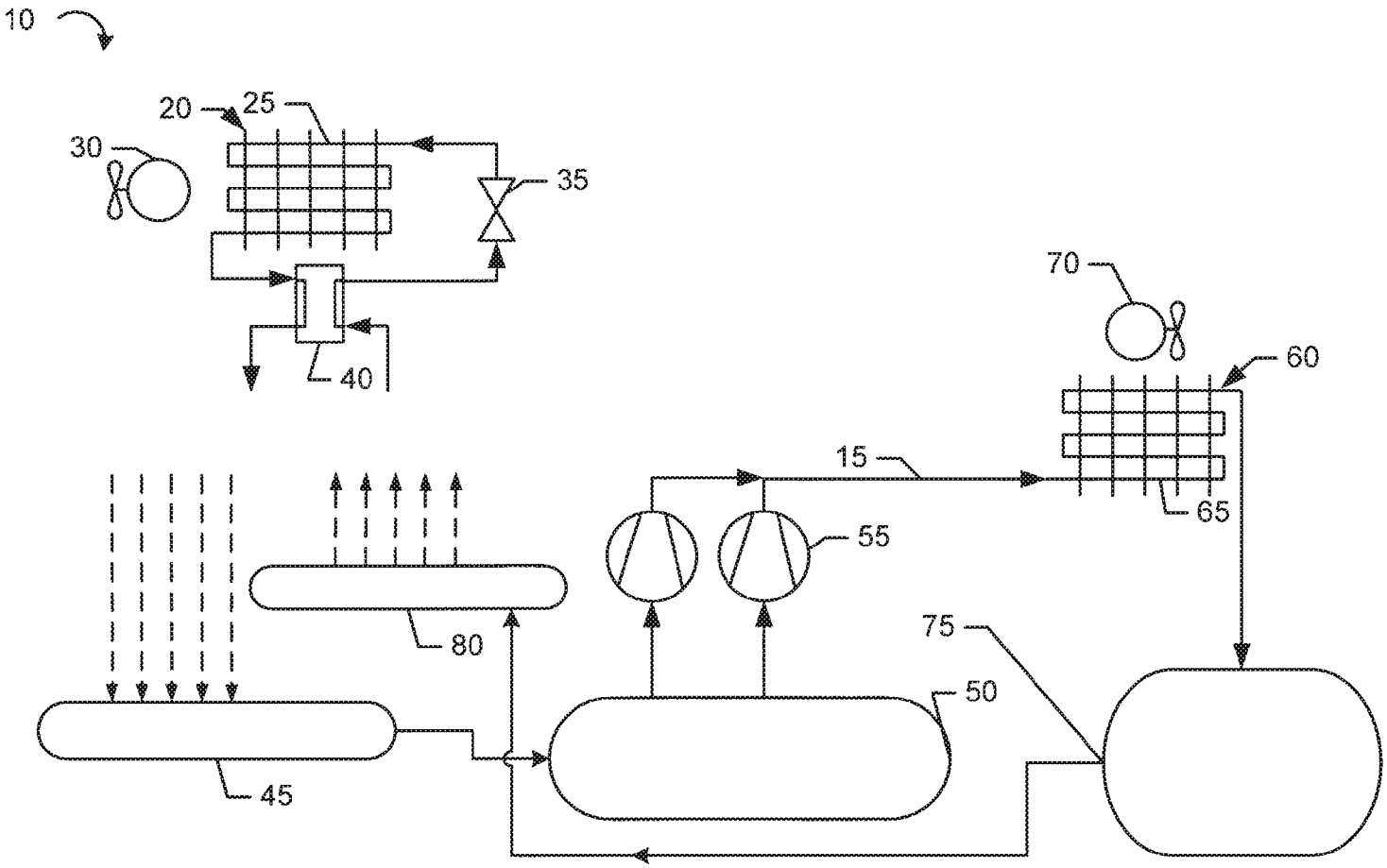
FIG. 1 is schematic diagram of a known refrigeration system with a suction line heat exchanger and an accumulator.

Referring now to the drawings, in which like numerals refer to like elements throughout the several views, FIG. 1 shows an example of a known refrigeration system 10. The refrigeration system 10 may be used to cool any type of a climate controlled area or a refrigerated space. The refrigerated space may be a refrigerator, a cooler, a building, and the like. The refrigeration system 10 may include a flow of a refrigerant 15. The refrigerant 15 may include conventional refrigerants such as hydrofluorocarbons, carbon dioxide, ammonia, and the like. Any type of refrigerant may be used herein.

The refrigeration system 10 may include an evaporator assembly 20. The evaporator assembly 20 may include one or more evaporator coils 25 and an evaporator fan 30. The evaporator assembly 20 may be positioned within or adjacent to the refrigerated space. The refrigeration system 10 also may include one or more expansion valves 35. The expansion valves may be positioned upstream of the evaporator assembly 20. The refrigeration system 10 also may include a suction line heat exchanger 40. The suction line heat exchanger 40 may be positioned upstream of the expansion valves 35 and downstream of the evaporator assembly 20. The suction line heat exchanger 40 exchanges heat with the cooler flow of refrigerant 15 entering the expansion valves 35 and the warmer flow of the refrigerant 15 leaving the evaporator assembly 20. Other types of heat exchangers may be used herein.

The flow of the refrigerant 15 leaving the suction line heat exchanger 40 may flow to a suction header 45. The suction header 45 may merge one or more flows of the refrigerant 15 and forward the flow to an accumulator 50. The accumulator 50 stores the refrigerant 15 therein until the refrigerant is needed downstream by one or more compressors 55. The compressors 55 compress the flow of refrigerant 15 and forward the flow on to a condenser assembly 60. The condenser assembly 60 may include one or more condenser coils 65 and a condenser fan 70. The condenser fan 70 pull ambient air over the condenser coil 65 for heat exchange with refrigerant 15. The refrigerant 15 then may flow to a receiver 75 and then on to a liquid header 80. The liquid header 80 may divide the flow of the refrigerant 15 into any number of flows with one or more of the refrigerant flows passing through the suction line heat exchanger 80. The cycle then may repeat.

The refrigeration system 10 described herein is for the purpose of example only. Many other types of refrigeration systems, refrigeration cycles, and refrigeration components may be known and used herein.

Figure 2:
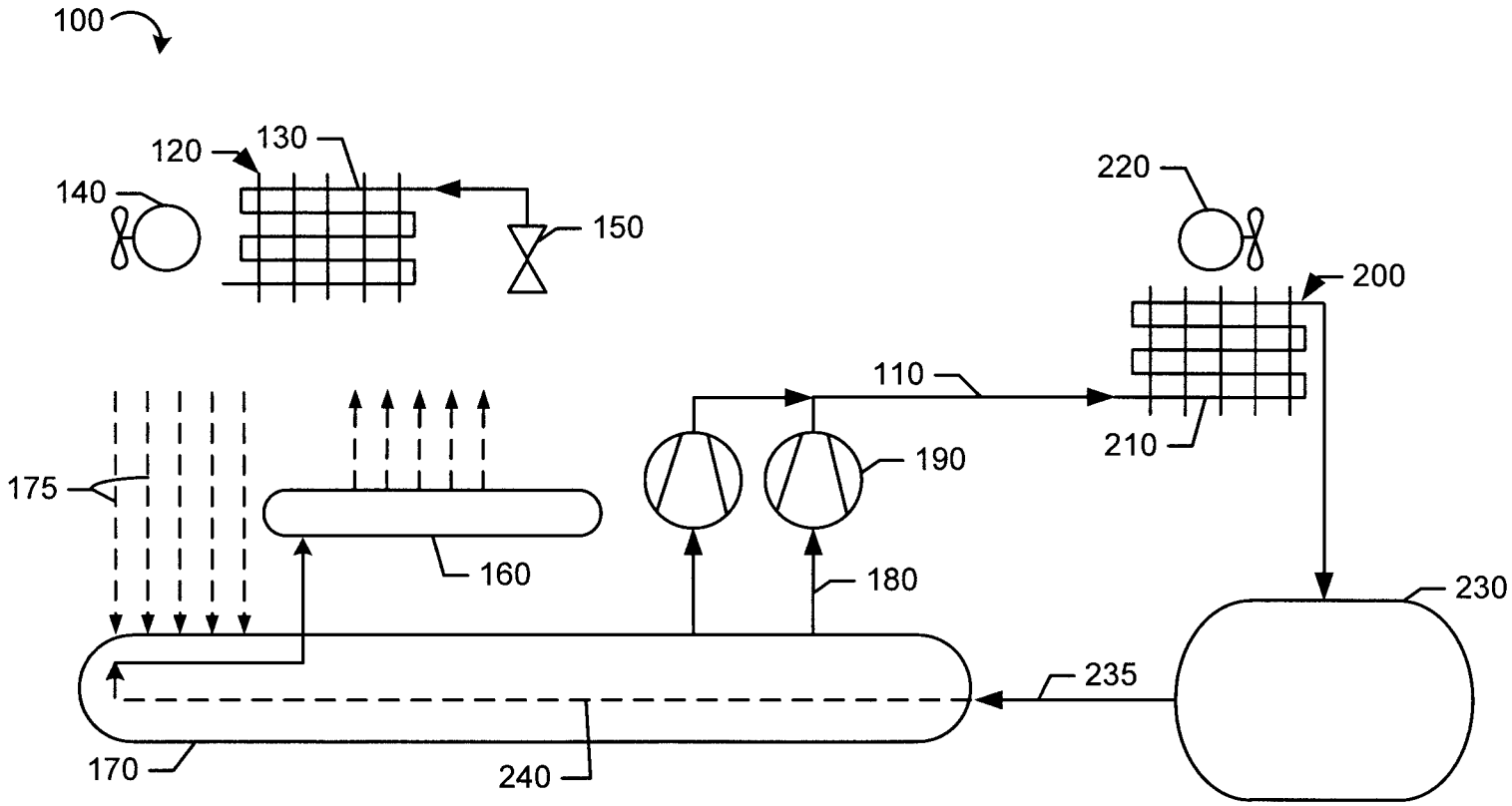
FIG. 2 is a schematic diagram of a refrigeration system with an integrated suction header assembly as may be described herein.

FIG. 2 shows an example of a refrigeration system 100 as may be described herein. The refrigeration system 100 may be used to cool any type of a climate controlled area or a refrigerated space. The overall refrigeration system 100 and the components thereof may have any suitable size, shape, configuration, or capacity. Heating applications also may be used herein. The refrigeration system 100 also may include a flow of a refrigerant 110. The refrigerant 110 may include conventional refrigerants such as hydrofluorocarbons, carbon dioxide, ammonia, and the like. Any type of refrigerant may be used herein.

The refrigeration system 100 may include an evaporator assembly 120. The evaporator assembly 120 may include one or more evaporator coils 130 and an evaporator fan 140. The evaporator 120 may be positioned within or adjacent to the refrigerated space. The evaporator fan 140 pulls in air from the refrigerated space and over the evaporator coils 130 so as to exchange heat with the refrigerant 110. The evaporator assembly 120 may be of conventional design and may have any suitable size, shape, configuration, or capacity. The refrigeration system 100 also may include one or more expansion valves 150. The expansion valves 150 may reduce the pressure and temperature of the refrigerant 110. The expansion valve 150 may be of conventional design and may have any suitable size, shape, configuration, or capacity. Other components and other configurations may be used herein.

Instead of the use of the suction line heat exchanger 40 as described above, the evaporator assembly 120 and the expansion valves 150 may be in communication with a liquid header 160 on an upstream end thereof and a suction header assembly 170 on a downstream end thereof. The liquid header 160 may be of conventional design and may have any suitable size, shape, configuration, or capacity. The suction header assembly 170 may merge any number of evaporator flows 175 of the refrigerant 110 from the evaporator assembly 120. The suction header assembly 170 may have any suitable size, shape, configuration, or capacity. Likewise, instead of the accumulator 50 as described above, the suction header assembly 170 may forward any number of compressor flows 180 of the refrigerant 110 to any number of compressors 190. The compressors 190 compress the flows of the refrigerant 110. The compressors 190 may be of conventional design and may have any suitable size, shape, configuration, or capacity. Other components and other configurations may be used herein.

The refrigeration system 100 may include a condenser assembly 200 downstream of the compressors 190. The condenser assembly 200 may include any number of condenser coils 210 and a condenser fan 220. The condenser fan 220 pulls in ambient air over the condenser coils 210 for heat exchange with the refrigerant 110. The condenser assembler 200 may be of conventional design and may have any suitable size, shape, configuration, or capacity. The condensed refrigerant 110 may be stored in a receiver 230. The receiver 230 may be of conventional design and may have any suitable size, shape, configuration, or capacity.

Instead of a receiver flow 235 of the refrigerant 110 flowing directly from the receiver 230 to the liquid header 160 as is described above, the receiver flow 235 may flow through a suction header heat exchanger 240 in the suction header assembly 170. The suction header heat exchanger 240 may run the length of the suction header assembly 170 for sub-cooling with a counter flow of the evaporator flow 175 leaving the evaporator assembly 120. The evaporator flow 175 then may be directed to the liquid header 160 and the cycle may be repeated. The suction heat exchanger 240 may have any suitable size, shape, configuration, or capacity. Other components and other configurations also may be used herein.

The refrigeration system 100 thus eliminates the suction line heat exchanger 40 and the accumulator 50 through the use of the suction header assembly 170 with the suction header heat exchanger 240 running therethrough. The suction header assembly 170 thus provides energy savings by lowering the liquid temperature of the receiver flow 235 leaving the receiver 230 by heat exchange with the evaporator flow 175 without the use of an additional external device. Specifically, the suction header assembly 170 reduces the potential for slugging due to low superheat, provides energy savings due to liquid sub-cooling, and provides an overall reduced part count with an associated cost savings. Specifically, the suction header heat exchanger 240 sub-cools the receiver flow 235 so as to reduce the superheat required at the load. The suction header heat exchanger 240 also protects the compressors 190 from liquid damage without the use of an additional heat exchanger. Reducing the temperature of the refrigerant flow 110 entering the liquid header 160 may improve the overall efficiency of the refrigeration system 100. Specifically, flow losses may be substantially less in the suction header assembly 170 as compared to the use of the external suction line heat exchanger described above.

Figure 3:
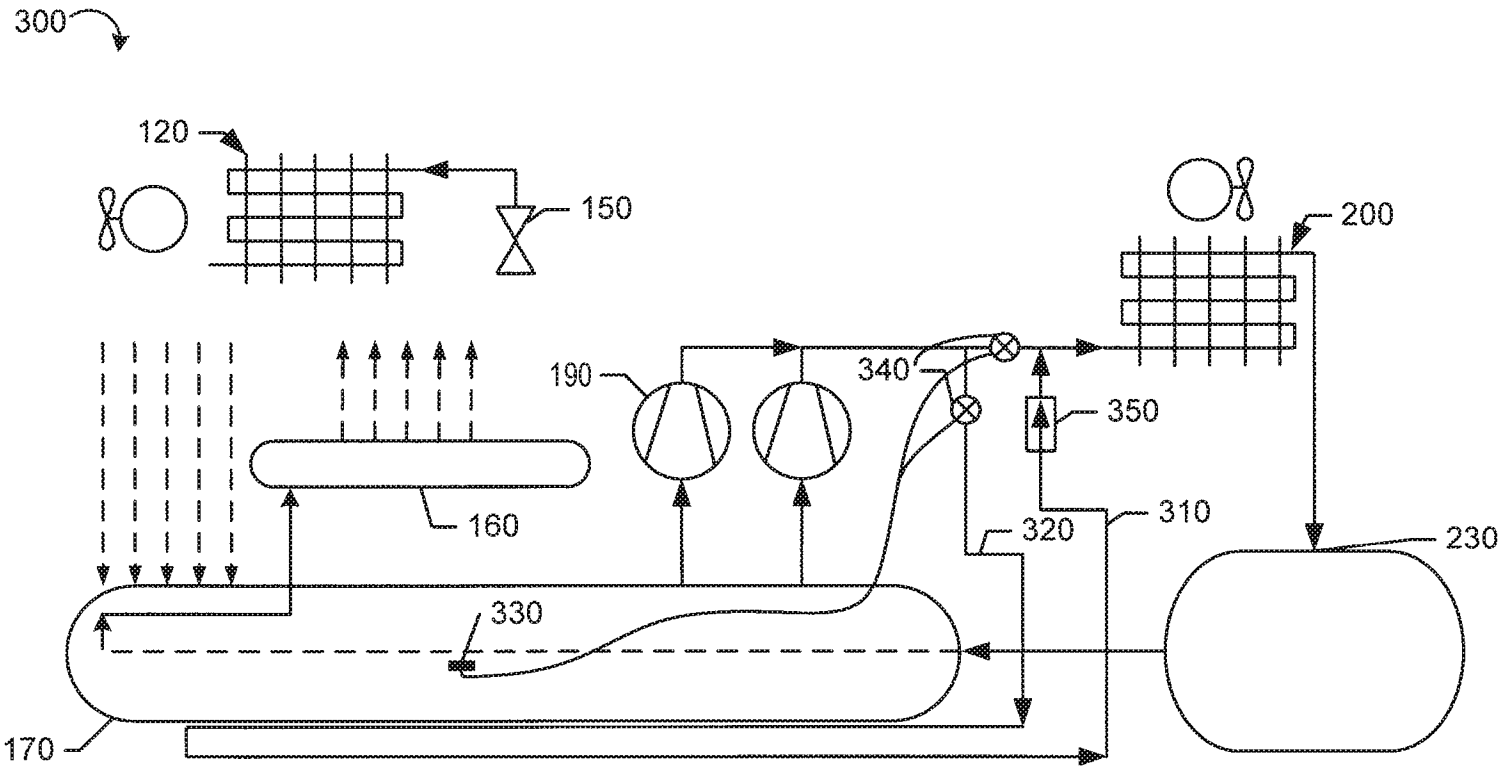
FIG. 3 is a schematic diagram of an alternative embodiment of a refrigeration system as may be described herein.

FIG. 3 shows an alternative embodiment of a refrigeration system 300 as may be described herein. The refrigeration system 300 may include the components of the refrigeration system 10, the refrigeration system 100, or similar types of refrigeration systems. In this example, the refrigeration system 300 includes a hot gas diversion assembly 310. The hot gas diversion assembly 310 may include a diversion heat exchanger line 320. The diversion heat exchanger line 320 may extend from downstream of the compressors 190, along part or all of the length of the suction header assembly 170, and then may return upstream of the condenser assembly 200. The hot gas diversion assembly 310 may include one or more temperature sensors 330 positioned about the suction header assembly 170 or elsewhere. The temperature sensors 330 may be of conventional design. Other types of sensors may be used herein. The temperature sensor 330 may be in communication with one or more solenoid valves 340. The solenoid valves 340 may be any type of conventional on-off valves. Other types of valves may be used herein. The solenoid valves 340 may be positioned on the diversion heat exchanger line 320 as well as upstream of the condenser assembly 200 so as to open or close the diversion heat exchanger line 320. A diversion heat exchanger line check valve 350 and the like also may be used. Other components and other configuration s may be used herein.

When the suction temperature and the corresponding superheat of the flow of the refrigerant 110 through the suction header assembly 170 may be low as determined by the temperature sensors 330, the solenoid valves 340 may divert the flow of the refrigerant 110 through the diversion heat exchanger line 320. The refrigerant 110 in the diversion heat exchanger line 320 thus may exchange heat with the flows of refrigerant in the suction header assembly 170. The hot gas diversion assembly 310 thus provides superheat and compressor protection that may be self-adjusting depending upon certain system failures, i.e., check valve failure, excessive low ambient temperature, and the like. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A refrigeration system, comprising:

an evaporator assembly;

a suction header assembly comprising a reservoir and coupled to an outlet of the evaporator assembly, wherein the suction header assembly is configured to reduce the potential for slugging due to low superheat and to provide energy savings due to liquid sub-cooling;

a suction header heat exchanger disposed throughout a length of the reservoir of the suction header assembly and within the reservoir of the suction header assembly, wherein the suction header heat exchanger is configured to sub-cool a flow of refrigerant passing through the suction header heat exchanger with a counter flow of at least one evaporator flow from the evaporator assembly flowing through the reservoir, so as to reduce any superheat required by a load;

a hot gas diversion assembly comprising a diversion heat exchanger line extending downstream of one or more compressors, along the suction header assembly, and upstream of a condenser assembly;

a temperature sensor disposed within the reservoir of the suction header assembly and electrically coupled to at least one valve, the at least one valve controlling passage of refrigerant into the hot gas diversion assembly in response to temperature measured by the sensor; and a liquid header configured to receive a direct refrigerant flow from the suction header heat exchanger, wherein the liquid header is functionally coupled between an inlet of the evaporator assembly and an outlet of the suction header heat exchanger, the liquid header configured to divide a received liquid into a plurality of flows.

2. The refrigeration system of claim 1, wherein the evaporator assembly comprises one or more evaporator coils and an evaporator fan.

3. The refrigeration system of claim 1, wherein the at least one evaporator flow comprises a plurality of evaporator flows; and wherein the suction header assembly comprises a plurality of inlets to merge the plurality of evaporator flows from the evaporator assembly.

4. The refrigeration system of claim 1, wherein the suction header assembly receives one or more evaporator flows of a refrigerant from the evaporator assembly.

5. The refrigeration system of claim 1, further comprising one or more compressors downstream of the suction header assembly.

6. The refrigeration system of claim 5, wherein the one or more compressors receive one or more compressor flows of a refrigerant from the suction header assembly.

7. The refrigeration system of claim 5, further comprising a condenser assembly downstream of the one or more compressors.

8. The refrigeration system of claim 7, wherein the condenser assembly comprises one or more condenser coils and a condenser fan.

9. The refrigeration system of claim 1, further comprising a receiver upstream of the suction header heat exchanger.

10. The refrigeration system of claim 9, further comprising a receiver flow of a refrigerant flowing from the receiver through the suction header heat exchanger and to the liquid header.

11. A method of operating a refrigeration system, comprising:

receiving, in a suction header assembly comprising a reservoir, an evaporator flow from an evaporator assembly, wherein the suction header assembly is configured to reduce the potential for slugging due to low superheat and to provide energy savings due to liquid sub-cooling;

flowing the evaporator flow through the reservoir of the suction header assembly;

receiving, in a suction header heat exchanger disposed throughout a length of the suction header assembly and within a reservoir of the suction header assembly, a receiver flow from a condenser assembly;

flowing the receiver flow through the suction header heat exchanger, wherein the suction header heat exchanger is configured to sub-cool the receiver flow with a counter flow of the evaporator flow when exchanging heat within the reservoir of the suction header assembly, so as to reduce any superheat required by a load;

measuring via a temperature sensor disposed within the reservoir of the suction header assembly, a temperature of the evaporator flow;

actuating, responsive to a temperature measured by the temperature sensor, at least one valve to direct refrigerant to a hot gas diversion assembly; and receiving, in a liquid header configured to receive the refrigerant flow directly from the suction header heat exchanger, the receiver flow from the suction header heat exchanger, the liquid header coupled between an inlet of the evaporator assembly and an outlet of the suction header heat exchanger and configured to divide a received liquid into a plurality of flows.

12. A refrigeration system, comprising:

an evaporator assembly;

a suction header assembly comprising a reservoir and coupled to an outlet of the evaporator assembly to receive an evaporator flow from the evaporator assembly, wherein the suction header assembly is configured to reduce slugging due to low superheat and to provide energy savings due to liquid sub-cooling;

a suction header heat exchanger disposed throughout a length of the suction header assembly and within the reservoir of the suction header assembly, wherein the suction header heat exchanger is configured to sub-cool a flow of refrigerant passing through the suction header heat exchanger with a counter flow of at least one evaporator flow from the evaporator assembly flowing through the reservoir, so as to reduce any super heat required by a load;

a receiver coupled to an inlet of the suction header heat exchanger;

a hot gas diversion assembly comprising a diversion heat exchanger line extending downstream of one or more compressors, along the suction header assembly, and upstream of a condenser assembly;

a temperature sensor disposed within the reservoir of the suction header assembly and electrically coupled to at least one valve, the at least one valve controlling passage of refrigerant into the hot gas diversion assembly in response to temperature measured by the sensor;

a liquid header configured to receive a refrigerant flow directly from the suction header heat exchanger, wherein the liquid header is functionally coupled between an inlet of the evaporator assembly and an outlet of the suction header heat exchanger, the liquid header configured to divide a received liquid into a plurality of flows; and wherein the suction header heat exchanger is configured to receive a receiver flow from the receiver such that the evaporator flow and the receiver flow exchange heat in the reservoir of the suction header assembly.

13. The refrigeration system of claim 12, further comprising one or more compressors downstream of the suction header assembly.

14. The refrigeration system of claim 13, further comprising a condenser assembly downstream of the one or more compressors.

15. The refrigeration system of claim 12, further comprising an expansion valve downstream of the liquid header and upstream of the evaporator assembly.

* * * * *